US006510582B1

(12) United States Patent
Yoo

(10) Patent No.: US 6,510,582 B1
(45) Date of Patent: Jan. 28, 2003

(54) VACUUM CLEANER TOOL CADDY FOR STORING ACCESSORY TOOLS

(75) Inventor: Myung-Sig Yoo, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/688,209

(22) Filed: Oct. 16, 2000

(30) Foreign Application Priority Data

May 22, 2000 (KR) ..... 2000-27527
May 22, 2000 (KR) ..... 2000-27528
May 22, 2000 (KR) ..... 2000-27529

(51) Int. Cl.[7] ..... A47L 9/00
(52) U.S. Cl. ..... 15/323
(58) Field of Search ..... 15/323, 339

(56) References Cited

U.S. PATENT DOCUMENTS 2,649,606 A * 8/1953 Fadner ..... 15/323
2,862,223 A * 12/1958 Meyerhoefer ..... 15/323
3,253,294 A * 5/1966 Waters ..... 15/323
3,778,863 A * 12/1973 Westergren et al. ..... 15/323
4,249,280 A * 2/1981 Goodrich ..... 15/339 X
4,959,885 A * 10/1990 Sovis et al. ..... 15/323 X
5,713,103 A * 2/1998 Keebler et al. ..... 15/323
6,098,241 A * 8/2000 Wood ..... 15/323
6,260,233 B1 * 7/2001 Wareham et al. ..... 15/323

* cited by examiner

*Primary Examiner*—Chris K. Moore
(74) *Attorney, Agent, or Firm*—Birch, Stewart, Kolasch & Birch, LLP

(57) ABSTRACT

A vacuum cleaner, provided with a detachable tool caddy unit, is disclosed. The tool caddy unit also has a pocket used for storing desired spare supplies, such as a spare dust bag or a spare transmission belt, on the cleaner body provided with a suction device for sucking dust-laden air into the cleaner body. The caddy unit consists of a mounting plate detachably mounted to the cleaner body, and a plurality of clamps for detachably holding a variety of accessory tools, such as a crevice nozzle, a brush nozzle and a flexible hose, on the caddy unit. In order to detachably mount the caddy unit on a predetermined portion of the cleaner body, a locking hook and two locking projections are formed on the mounting plate of the caddy unit, while a locking hole and two locking slots are formed on the cleaner body at positions corresponding to the locking hook and locking projections. A belt holding rib projects on the internal surface of the front cover or on the mounting plate of the caddy unit. This belt holding rib is used for holding a spare transmission belt within the pocket when necessary.

22 Claims, 11 Drawing Sheets

VACUUM CLEANER TOOL CADDY FOR STORING ACCESSORY TOOLS

BACKGROUND OF THE INVENTION

1. Field of the Invention

The present invention relates to vacuum cleaners and, more particularly, to a vacuum cleaner provided with a detachable tool caddy unit designed to be detachably mounted to the cleaner body and to properly hold a variety of accessory tools and spare supplies on the cleaner body.

2. Description of the Prior Art

As well known to those skilled in the art, vacuum cleaners are electric appliances, which generate suction force by using drive means, such as a motor, and clean carpets, floors, etc., through a suction process and a filtering process. Of such conventional vacuum cleaners, a vacuum cleaner of the upright type is designed to stand on a horizontal surface while moving on the surface during a cleaning process. Particularly, such an upright-type vacuum cleaner is effectively used for cleaning a carpet laid on a horizontal surface.

FIG. 1 shows a conventional upright-type vacuum cleaner. As shown in the drawing, the conventional upright-type vacuum cleaner comprises a cleaner body 10, which is designed to stand on a horizontal surface while moving on the surface during a cleaning process. A suction unit 20 is mounted to the lower portion of the body 10, and sucks air laden with dust and impurities from a target surface by suction force at its suction nozzle. Provided at the upper end of the cleaner body 10 is a handle 30, which is gripped by a user's hand while operating and moving the cleaner.

In the above vacuum cleaner, a flexible hose 40 extends from the body 10 to the suction unit 20, thus normally connecting the suction unit 20 to the cleaner body 10. In such a case, the connection structure between the suction unit 20 and the outside end of the flexible hose 40 comprises a detachable connection structure, and so it is possible for a user to selectively connect the outside end of the flexible hose 40 to either the suction unit 20 or an accessory tool, which will be described later herein, as desired.

FIGS. 2 and 3 are sectional views of the above-mentioned vacuum cleaner taken along the lines I—I and II—II of FIG. 1. As shown in the drawings, the conventional upright-type vacuum cleaner has the following construction.

That is, both a suction fan 11 and a fan motor 12 are set within the cleaner body 10, and generate desired suction force for the cleaner. In addition, a dust bag 13 is removably installed at a predetermined position of the upper portion within the body 10. The dust bag 13 is used for filtering sucked air to remove dust and impurities from the air prior to discharging the air from the body 10 into the atmosphere.

A brush roller 21 is mounted at the front end of the suction unit 20 at a position around the suction nozzle of the unit 20. This brush roller 21 is connected to the fan motor 12 through a power transmission belt 14 made of rubber, thus being rotatable by the rotating force of the fan motor 12 during a cleaning process. The above brush roller 21 actively brushes up dust and impurities from a carpet during a cleaning process of the carpet.

When the vacuum cleaner starts to clean a desired planar area, dust-laden air is sucked from the area into the suction unit 20 through the suction nozzle, provided at the front end portion of the bottom of the unit 20, by suction force formed by the fan 11 provided at the lower portion of the body 10. Thereafter, the sucked dust-laden air passes through the flexible hose 40 to reach the interior of the dust bag 13 installed within the body 10. The dust bag 13 thus filters the dust-laden air to remove dust and impurities from the air. In such a case, the filtered dust and impurities are collected within the dust bag 13. After the filtering process, air passes through the fan 11 prior to being discharged from the body 10 into the atmosphere. In such a case, the discharged air passes through an air discharging port, provided on the cleaner body 10.

As described above, the outside end of the flexible hose 40 is detachably connected to the suction unit 20, and so the cleaner is able to effectively clean a specific area, such as a crevice, which the suction nozzle of the fixed suction unit 20 cannot reach. That is, when it is desired to clean such a specific area using the cleaner, the outside end of the flexible hose 40 is removed from the suction unit 20 prior to an attachment of a desired accessory tool, such as a crevice nozzle 51 or a brush nozzle 52. When the crevice nozzle 51 or the brush nozzle 52 is attached to the outside end of the flexible hose 40 as described above, it is possible to effectively clean a specific area, such as a crevice, which the suction nozzle of the fixed suction unit 20 cannot reach.

The accessory tools, such as the crevice nozzle 51 and the brush nozzle 52, are given to a user along with the cleaner when the user purchases the cleaner. Such accessory tools are typically stored at an unfixed place separate from the cleaner body of the cleaner, and so they are inconvenient to the user since it is necessary for the user to take a desired accessory tool from such an unfixed place prior to mounting the tool to the outside end of the flexible hose 40. In practice, such accessory tools have to be often and intermittently used during a cleaning process, and the tools therefore cause an inconvenience to the user while taking them from an unfixed place during the cleaning process.

In an effort to overcome the above-mentioned problem, a vacuum cleaner, of which the body 10 has a desired number of tool holding recesses 10*a* having shapes and sizes capable of detachably holding the original accessory tools, such as the nozzles 51 and 52 on the body 10, has been proposed and used.

However, the vacuum cleaner having such specific holding recesses 10*a* is problematic in that the shapes and sizes of the recesses 10*a* are fixed even though the cleaner may be used with additional accessory tools having sizes and shapes different from those of the original accessory tools 51 and 52. That is, when an additional accessory tool, which is not included in the original accessory tools of the cleaner, is purchased and used, the additional accessory tool cannot be held on the specific holding recesses 10*a* of the body 10, but has to be stored at an unfixed place. In such a case, the vacuum cleaner causes an inconvenience to the user due to the additional accessory tool in the same manner as that described above.

In addition, the specific holding recesses 10*a*, necessarily formed on the body 10 of the vacuum cleaner, also cause a limitation in designing the body 10. That is, it is impossible to freely design the rear wall of the body 10 due to the holding recesses 10*a*. Such a limitation in the design of the body 10 regrettably reduces the market competitiveness of the cleaner.

Another problem experienced in the vacuum cleaner having such specific holding recesses 10*a* resides in that it does not have any means for holding desired spare supplies, such as spare dust bags, on the body 10 and forces a user to store the spare supplies at an unfixed place separate from the body 10. When a vacuum cleaner is designed to store desired spare supplies, such as spare dust bags, on its body 10, the cleaner is very convenient to the user while using the cleaner.

In addition, the power transmission belt 14, used for connecting the brush roller 21 to the fan motor 12, has to be replaced with a new one at the expiry of an expected life span of the belt 14. Therefore, it is sometimes necessary for the user to store one or more spare transmission belts. However, the body 10 of the convention vacuum cleaner is not provided with any means for storing such spare transmission belts, and so the spare belts create for the user an inconvenience in the storage of them at an unfixed place separate from the body 10.

SUMMARY OF THE INVENTION

Accordingly, the present invention has been made keeping in mind the above problems occurring in the prior art, and an object of the present invention is to provide a vacuum cleaner, which is provided with a detachable tool caddy unit for easily holding a variety of accessory tools on the body of the leaner, and is convenient to the user.

Another object of the present invention is to provide a vacuum cleaner, which is provided with a means for easily storing desired spare supplies, such as a spare dust bag or a spare transmission belt, on the body of the cleaner, and is convenient to the user.

In order to accomplish the above object, the present invention provides a vacuum cleaner, comprising a cleaner body provided with a suction means for sucking dust-laden air into the cleaner body; a caddy unit detachably mounted to the cleaner body and used for detachably holding a variety of accessory tools on the cleaner body, the caddy unit consisting of a mounting plate detachably mounted to the cleaner body, with a clamp formed on the mounting plate and used for detachably holding the accessory tools on the plate; and a means for detachably mounting the caddy unit on a predetermined portion of the cleaner body.

In an embodiment, the caddy unit mounting means comprises: a locking hook provided at the upper portion of the mounting plate of the caddy unit, a locking projection provided at the lower portion of the mounting plate, a locking hole formed on a predetermined portion of the cleaner body at a position corresponding to the locking hook and brought into detachable engagement with the locking hook when the caddy unit is mounted to the cleaner body, and a locking slot formed on a predetermined portion of the cleaner body at a position corresponding to the locking projection and brought into detachable engagement with the locking projection. The locking slot is downwardly inclined rearward at its front surface, thus allowing the tool caddy unit to be more easily and simply mounted to the cleaner body.

A pocket, used for storing desired articles therein, may be provided on a predetermined portion of the caddy unit. This pocket comprises two sidewalls perpendicularly extending out of opposite side edges of the mounting plate of the caddy unit at the lower portion of the mounting plate, and a front cover hinged to the lower portion of the mounting plate and used for selectively forming the pocket in cooperation with the two sidewalls when it is fully closed.

In addition, a belt holding rib projects on the internal surface of the front cover or on the mounting plate of the caddy unit. This belt holding rib is used for holding a spare transmission belt within the pocket when necessary.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 6:
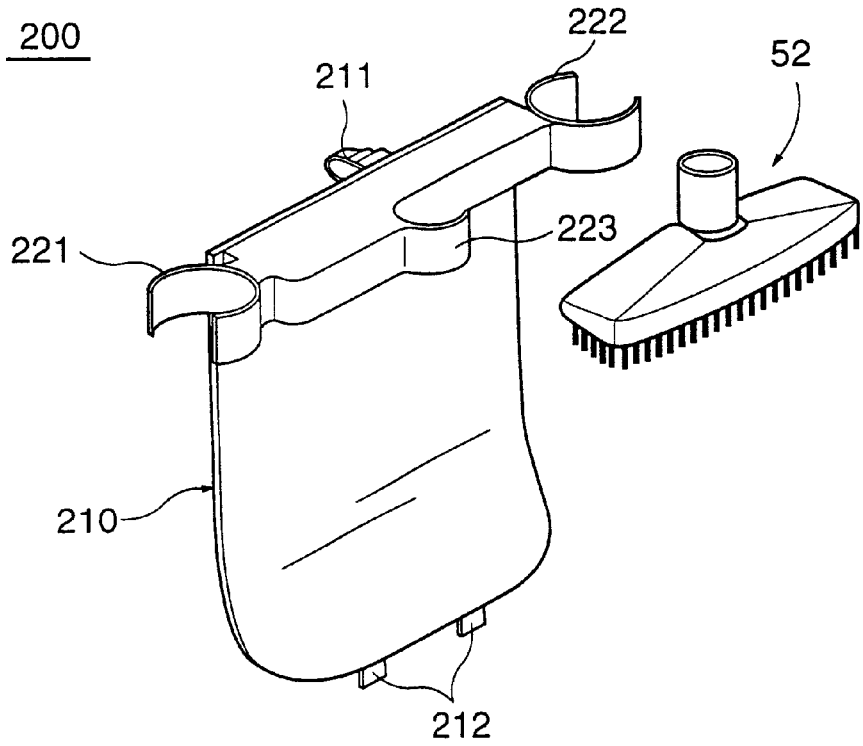
FIG. 6 is a perspective view of a detachable tool caddy unit of an upright-type vacuum cleaner in accordance with the primary embodiment of the present invention.
Figure 7:
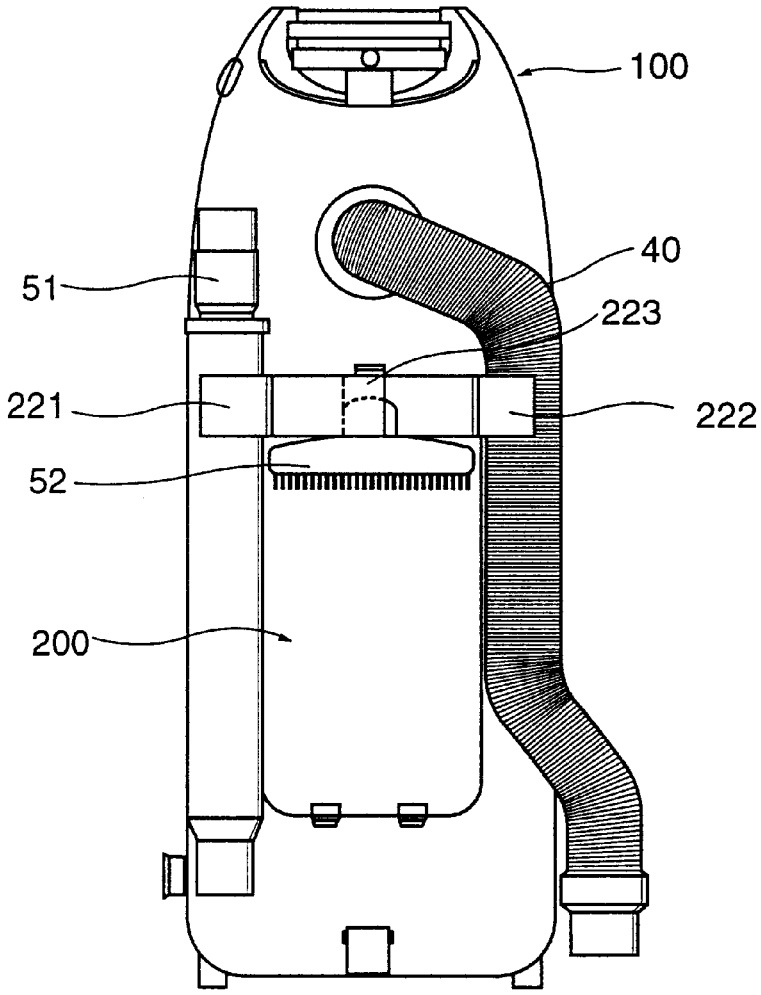
FIG. 7 is a rear view of the vacuum cleaner provided with the tool caddy unit of FIG. 6.

FIG. 6 is a perspective view of a detachable tool caddy unit of an upright-type vacuum cleaner in accordance with the primary embodiment of the present invention. FIG. 7 is a rear view of the vacuum cleaner provided with the tool caddy unit of FIG. 6. As shown in the drawings, the tool caddy unit 200 of the primary embodiment of the invention is designed to be detachably mounted to the rear surface of the cleaner body 100 at its mounting plate 210.

In a detailed description, the tool caddy unit 200 of this invention consists of a mounting plate 210, which is detachably mounted to a desired surface of the cleaner body 100, for example, to the rear surface of the cleaner body 100. Since the mounting plate 210 has a flat planar shape, it is possible to easily and detachably mount the caddy unit 200 to the desired rear surface of the cleaner body 100. Therefore, the rear surface of the cleaner body 100 does not have conventional tool holding recesses, and so the design flexibility of the cleaner body 100 is improved. This finally enhances the market competitiveness of the vacuum cleaner.

The vacuum cleaner of this invention is provided with a means for detachably mounting the plate 210 of the tool caddy unit 200 on the rear surface of the cleaner body 100. In the preferred embodiments of the present invention, the mounting means for the tool caddy unit comprises one locking hook 211 formed at the upper portion of the mounting plate 210 and two locking projections 212 integrally extending downwardly from the lower edge of the mounting plate 210. Of course, it should be understood that the number of the locking hook 211 and the locking projections 212 may be freely changed as desired without affecting the functioning of the invention.

A plurality of clamps 221, 222 and 223 are formed on the upper portion of the mounting plate 210. The clamps 221, 222 and 223 are used for detachably holding a plurality of accessory tools, such as a flexible hose 40 and a variety of accessory tools 51 and 52, on the plate 210. Each of the above clamps 221, 222 and 223 has a cylindrical shape, which is partially open at a desired portion so as to allow an insertion of the hose 40 or an accessory tool into an associated clamp. That is, the flexible hose 40 and the accessory tools, such as a crevice nozzle 51 and a brush nozzle 52, are detachably clamped by the clamps 221, 222 and 223 of the caddy unit 200.

In the primary embodiment, the caddy unit 200 has three clamps 221, 222 and 223 at the upper portion of the mounting plate 210. Of the three clamps 221, 222 and 223, the first and second clamps 221 and 222 are positioned around opposite side edges of the mounting plate 210, while the third clamp 223 is positioned at the center of the plate 210. In the embodiment, the shape of the third clamp 223 is slightly different from that of the first and second clamps 221 and 222, but it should be understood that the operational function of the third clamp 223 is equal to that of the first and second clamps 221 and 222. In addition, the opening of the third clamp 223, formed to allow a reception of a desired accessory tool into the clamp 223, is opened rightward in the drawings. However, it should be understood that the direction of the opening may be changed as desired.

Figure 8:
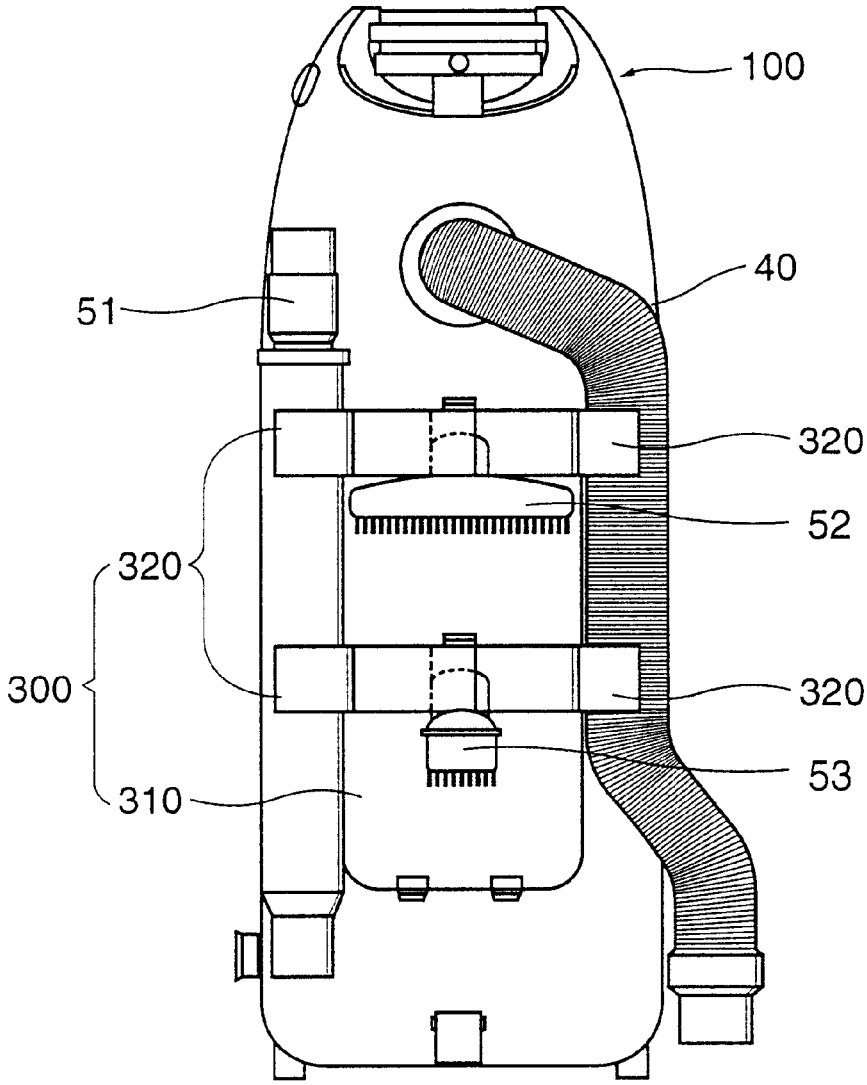
FIG. 8 is a rear view of a vacuum cleaner provided with a detachable tool caddy unit in accordance with a modification of the primary embodiment of the present invention.

FIG. 8 is a rear view of a vacuum cleaner provided with a detachable tool caddy unit in accordance with a modification of the primary embodiment of the present invention. In this modification, the tool caddy unit 300, detachably mounted to the rear surface of the cleaner body 100, has two rows of clamps 320. That is, the two rows of clamps 320 are horizontally positioned at the upper and middle portions of the mounting plate 310 of the caddy unit 300. In such a case, each row of clamps 320 has the same construction as that described for the embodiment of FIG. 6. In this modification with the two rows of clamps 320, it is possible to effectively hold a variety of accessory tools 52 and 53 in addition to the crevice nozzle 51 and the flexible hose 40 on the cleaner body 100.

In the primary embodiment, the clamps 221, 222, 223, 320 are integrally formed with the mounting plate 210, 310 using a plastic material through an injection molding process, and so the clamps 221, 222, 223, 320 have elasticity due to the plastic material. Therefore, it is possible to elastically and detachably hold the crevice nozzle 51, the brush nozzle 52 and the flexible hose 40 in the clamps 221, 222, 223, 320.

In the present invention, the mounting plate 210 or 310 of the caddy unit 200 or 300 preferably has a width smaller than that of the rear surface of the cleaner body 100. When the width of the mounting plate 210 or 310 of the caddy unit 200 or 300 is larger than that of the rear surface of the cleaner body 100, the accessory tools 51, 52 and 53 may project from opposite sides of the cleaner body 100 and interfere with the surroundings during a cleaning process. In such a case, the accessory tools 51, 52 and 53 are inconvenient to the user.

The structure for detachably mounting the tool caddy unit 200 or 300 according to the primary embodiment of the present invention to the rear surface of the cleaner body 100 will be described in detail herein below with reference to FIG. 9*a*.

As shown in the drawing, the tool caddy unit 200 of this invention is detachably mounted to the rear surface of the cleaner body 100. In order to allow the detachable attachment of the tool caddy unit 200 to the rear surface of the cleaner body 100, a locking hole 101 is formed on the upper portion of the rear surface of the cleaner body 100 at a position corresponding to the locking hook 211 of the caddy unit 200. When the locking hook 211 is inserted into the locking hole 101, the hook 211 is brought into elastic detachable engagement with the locking hole 101. In the preferred embodiment, a snap protrusion 211*a* is formed on the locking hook 211, while a groove 101*a* is formed on the internal surface of the locking hole 101 at a position corresponding to the snap protrusion 211*a*. When the caddy unit 200 is mounted to the cleaner body 100, the snap protrusion 211*a* of the locking hook 211 comes into elastic engagement with the groove 101*a* of the locking hole 101. Therefore, a stable attachment of the caddy unit 200 to the cleaner body 100 is accomplished.

On the other hand, two locking slots 102 are formed on the lower portion of the rear surface of the cleaner body 100 at a position corresponding to the locking projections 212 of the caddy unit 200. The above locking slots 102 are brought into detachable engagement with the locking projections 212 when the caddy unit 200 is mounted to the cleaner body 100. In the vacuum cleaner, each of the locking slots 102 is downwardly inclined rearward at its front surface 102*a*.

Of course, it should be understood that the structure of the locking hook 211, locking projections 212, the locking hole 101 and the locking slots 102 used for detachably mounting the caddy unit 200 to the rear surface of the cleaner body 100 may be somewhat freely changed from the above-mentioned structure without affecting the functioning of the present invention.

The operational effect of the detachable tool caddy unit 200 or 300 of the primary embodiment will be described herein below.

Figure 9A:
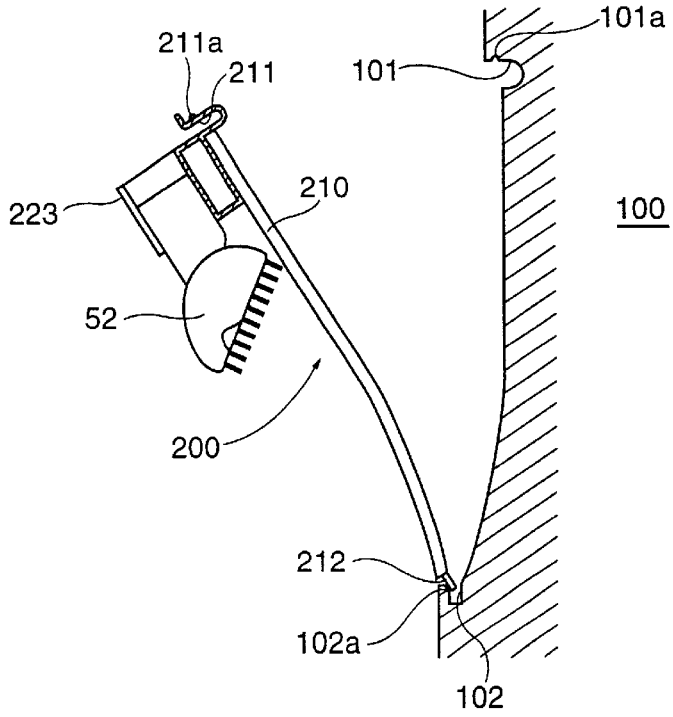
FIG. 9*a* is a side view, showing an initial stage of a process of mounting the detachable tool caddy unit of FIG. 6 to the body of the cleaner.
Figure 9B:
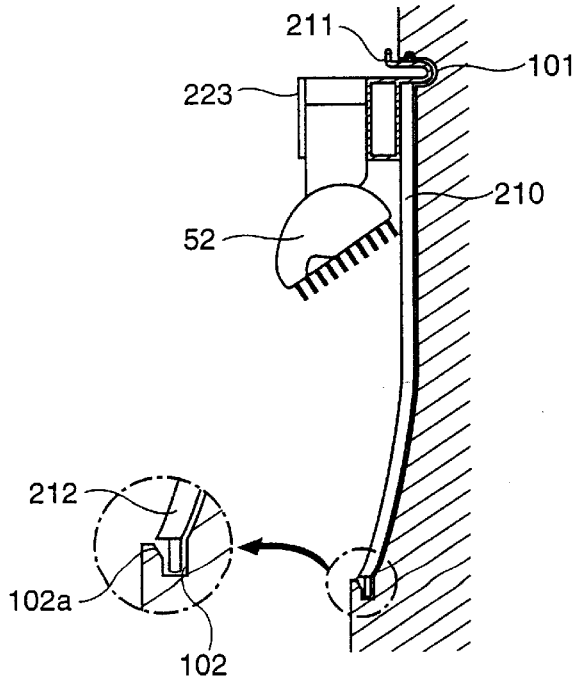
FIG. 9*b* is a side view, showing a final stage of the process of mounting the detachable tool caddy unit of FIG. 6 to the body of the cleaner.

FIGS. 9*a* and 9*b* are side views, showing a process of mounting the detachable tool caddy unit 200 of FIG. 6 to the cleaner body 100.

When it is desired to mount the caddy unit 200 to the rear surface of the cleaner body 100, the two locking projections 212, formed at the lower edge of the mounting plate 210 of the caddy unit 200, are primarily inserted into the locking slots 102 of the cleaner body 100 as shown in FIG. 9*a*. In such a case, since each of the locking slots 102 is downwardly inclined rearward at its front surface 102*a* as described above, the locking projections 212 of the caddy unit 200 are easily inserted into the locking slots 102 while inclining the mounting plate 210 of the caddy unit 200 as shown in FIG. 9*a*.

After the locking projections 212 of the caddy unit 200 are inserted into the locking slots 102 of the cleaner body 100, the upper portion of the mounting plate 210 is rotated around the locking projections 212 in a direction toward the rear surface of the cleaner body 100. The caddy unit 200 is, thereafter, forced toward the cleaner body 100, and so the locking hook 211 of the caddy body 200 is inserted into the locking hole 101 of the cleaner body 100. The desired engagement of the locking hook 211 with the locking hole 101 is accomplished.

The position of the caddy unit 200 completely mounted to the rear surface of the cleaner body 100 is shown in FIG. 9*b*. When it is desired to remove the caddy unit 200 from the cleaner body 100, the unit 200 is easily removed from the body 100 by manipulating the unit 200 in the reverse order.

As described above, the caddy unit 200 of this invention is provided with a plurality of clamps 221, 222, 223, 320 for detachably clamping a variety of accessory tools, such as the crevice nozzle 51, the brush nozzles 52 and 53, and the flexible hose 40. Therefore, the vacuum cleaner of this invention provided with such a detachable tool caddy unit 200 allows a user to store a variety of accessory tools on the cleaner body, and is convenient to the user.

In addition, the tool caddy unit 200 of this invention is detachably mounted to the rear surface of the cleaner body 100 by a simple structure designed to easily mount the caddy unit 200 to the cleaner body 100. That is, in order to detachably mount the caddy unit 200 to the cleaner body 100, the caddy unit 200 has a locking hook and two locking projections, while the cleaner body 100 has a locking hole and two locking slots on its rear surface. Therefore, the rear surface of the cleaner body 100 is simply designed, and so the cleaner of this invention is improved in its design flexibility and is enhanced in its market competitiveness.

Figure 10:
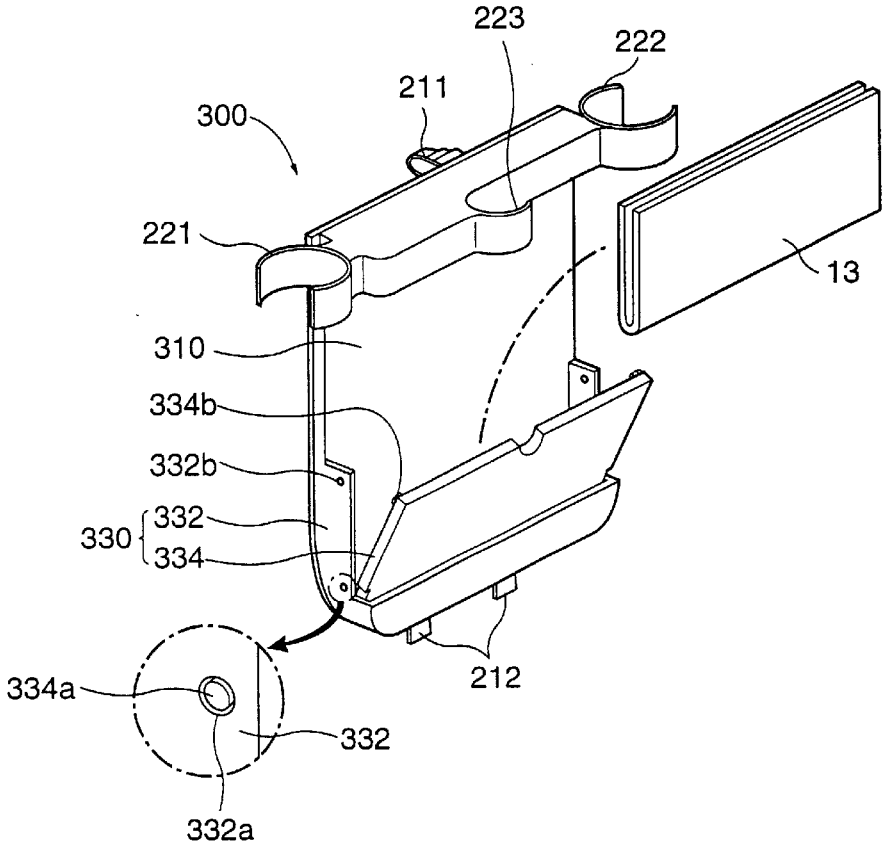
FIG. 10 is a perspective view of a detachable tool caddy unit of an upright-type vacuum cleaner in accordance with the second embodiment of the present invention.

FIG. 10 is a perspective view of a detachable tool caddy unit of an upright-type vacuum cleaner in accordance with the second embodiment of the present invention. In the second embodiment, the general shape of the caddy unit remains the same as that described for the primary embodiment, but a pocket for storing spare supplies, such as spare dust bags and spare transmission belts, is formed on the caddy unit. Those elements similar to both the primary and second embodiments carry the same reference numerals and further explanation is not deemed necessary.

The detachable tool caddy unit 300 according to the second embodiment has a pocket 330 designed to effectively store spare supplies, such as spare dust bags 13 and spare transmission belts 14.

As shown in FIG. 10, the pocket 330 is provided at the lower portion of the mounting plate 310 of the caddy unit 300. The pocket 330 can store desired articles, such as a manual and a written guarantee, in addition to the spare supplies.

In the preferred embodiment, the pocket 330 is formed at the lower portion of the mounting plate 310 of the caddy unit 300 and is provided with an openable front cover. However, it should be understood that the position and structure of the pocket 330 may be changed without affecting the functioning of the invention.

In the second embodiment of FIG. 10, the pocket 330 comprises two sidewalls 332, which perpendicularly extend out of opposite side edges of the mounting plate 310 of the caddy unit 300 at a lower portion of the mounting plate 310. A front cover 334 is hinged to the lower portion of the two sidewalls 332 at its lower corners so as to be rotatable around the hinged joints formed between the cover 334 and the sidewalls 332.

In a detailed description, the two sidewalls 332 perpendicularly extend out of opposite side edges of the mounting plate 310 of the caddy unit 300 and form a space between them. On the other hand, the front cover 334 is hinged to the lower portion of the two sidewalls 332 at its lower corners. This front cover 334 is rotatable around the hinged joints, thus selectively closing or opening the pocket 330. In the preferred embodiment, the top portion of the pocket 330 is always open regardless of the position of the front cover 334 relative to the sidewalls 332. However, it should be understood that it is possible to design the top portion of the pocket 330 to be closed by forming a horizontal wall between the top ends of the two sidewalls 320 or by forming a flange along the top edge of the front cover 334.

In order to hinge the cover 334 to the sidewalls 332, a hinge shaft 334*a* is formed at each corner of the lower portion of the cover 334. A shaft hole 332*a* is formed at the lower portion of each sidewall 332, and is brought into rotatable engagement with the hinge shaft 334*a*. Due to the rotatable engagement of the hinge shafts 334*a* of the cover 334 with the shaft holes 332*a* of the sidewalls 332, the cover 334 is rotatably mounted to the sidewalls 332 and forms a desired pocket 330 on the caddy unit 300.

Two locking projections 334*b* are formed at opposite corners of the upper edge of the front cover 334. Two locking holes 332*b* are formed on the two sidewalls 332 at positions corresponding to the two locking projections 334*b* and come into engagement with the projections 334*b*, thus holding the front cover 334 at a closed position on the sidewalls 332. When the front cover 334 is fully rotated counterclockwise in the drawing around the hinge shafts 334*a* by a user, the locking projections 334*b* come into elastic engagement with the locking holes 332*b* of the sidewalls 332, thus allowing the front cover 334 to be maintained at a closed position relative to the sidewalls 332. On the other hand, when the front cover 334 is rotated clockwise in the drawing around the hinge shafts 334*a* by the user, the locking projections 334*b* are removed from the locking holes 332*b*, thus allowing the cover 334 to be opened.

The construction of the pocket 330 may be modified as desired without affecting the functioning of the present invention.

That is, in the preferred embodiment, the front cover 334 is hinged to the lower ends of the two sidewalls 332 at its lower corners. However, the lower portion of the cover 334 may be hinged to the lower portion of the mounting plate 310 of the caddy unit 300 in place of the two sidewalls 320.

Alternatively, the front cover 334 may be formed separate from the sidewalls 332 prior to being fixed along the outside edges of the two sidewalls at its opposite sides, thus forming a fixed pocket having an opening at the top portion. As a further alternative, the front cover 334 may be integrally formed with the two sidewalls 322 through an injection molding process.

The tool caddy unit 300 according to the second embodiment is detachably mounted to a desired portion, for example, a rear surface, of the cleaner body 100 in the same manner as that described for the primary embodiment and further explanation is thus not deemed necessary.

In the vacuum cleaner having the detachable tool caddy unit 300 according to the second embodiment, it is possible to detachably hold a variety of accessory tools, such as a crevice nozzle 51 and a brush nozzle 52, on the clamps 221, 222 and 223 of the tool caddy unit 300 and to easily store a variety of articles, such as spare dust bags 13, spare transmission belts 14, a manual and a written guarantee, in the pocket 330.

Figure 11:
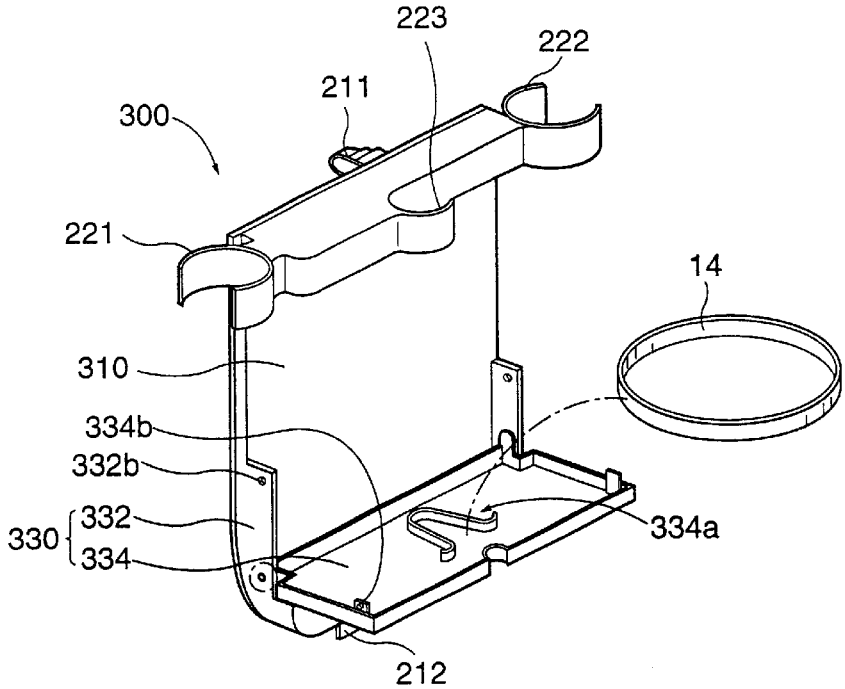
FIG. 11 is a perspective view of a detachable tool caddy unit of an upright-type vacuum cleaner in accordance with the third embodiment of the present invention.

FIG. 11 is a perspective view of a detachable tool caddy unit of an upright-type vacuum cleaner in accordance with the third embodiment of the present invention.

In the third embodiment, the general shape of the caddy unit remains the same as that described for the second embodiment, but a belt holding rib projects on the interior surface of the front cover, and is used for holding a spare transmission belt within the pocket when: necessary. Those elements similar to both the second and third embodiments carry the same reference numerals and further explanation is not deemed necessary.

Figure 1:
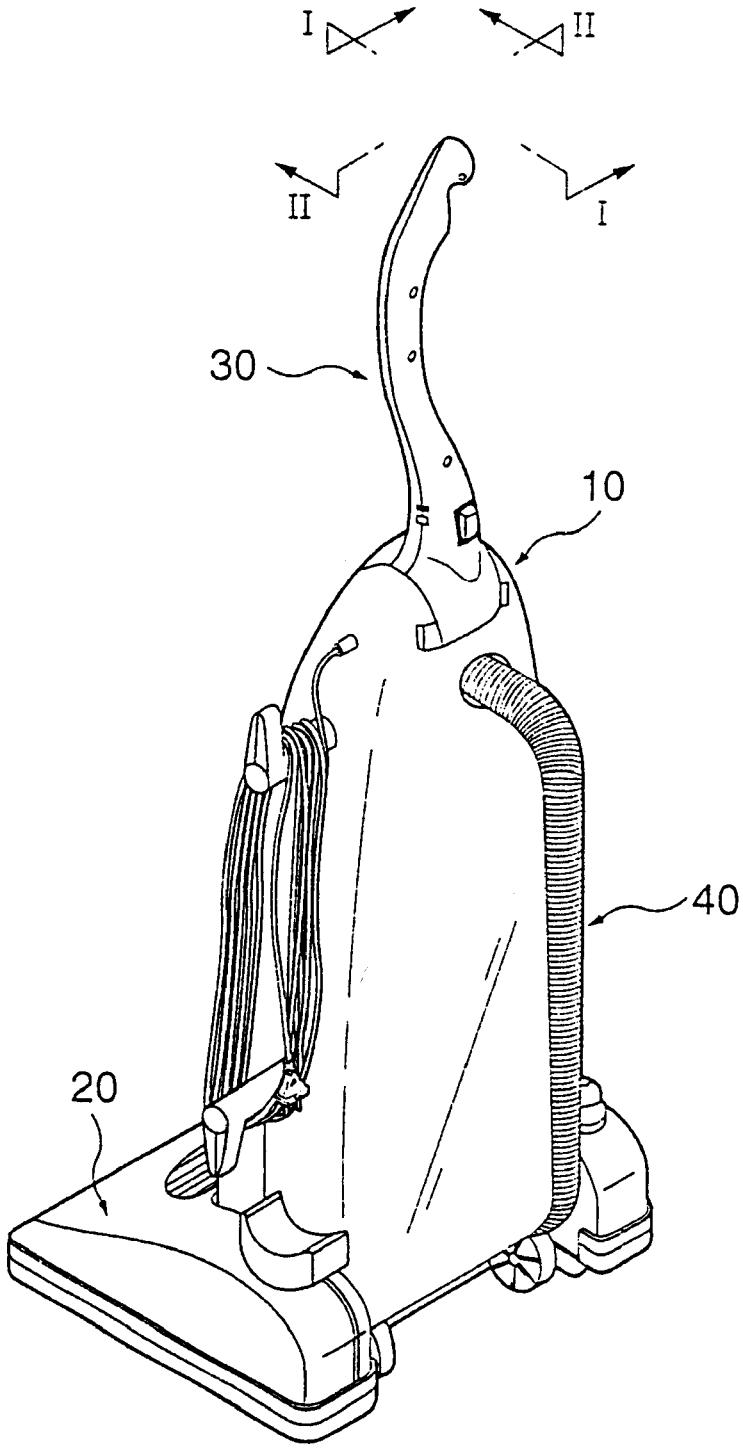
FIG 1. BACKGROUND ART
FIG. 1 is a rear perspective view of a conventional upright-type vacuum cleaner.
Figure 2:
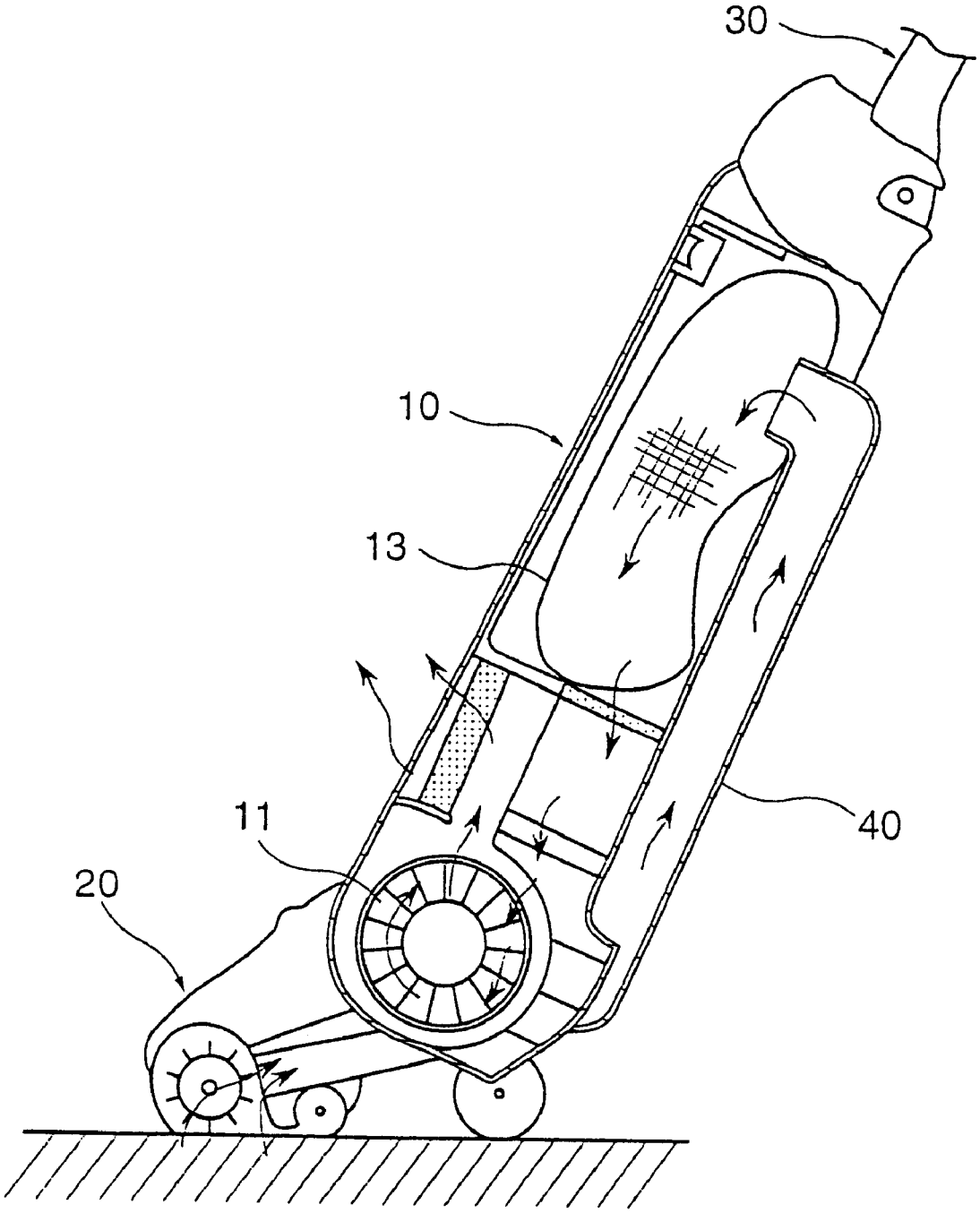
FIG 2. BACKGROUND ART
FIG. 2 is a sectional view of the conventional upright-type vacuum cleaner taken along the line I—I of FIG. 1.
Figure 3:
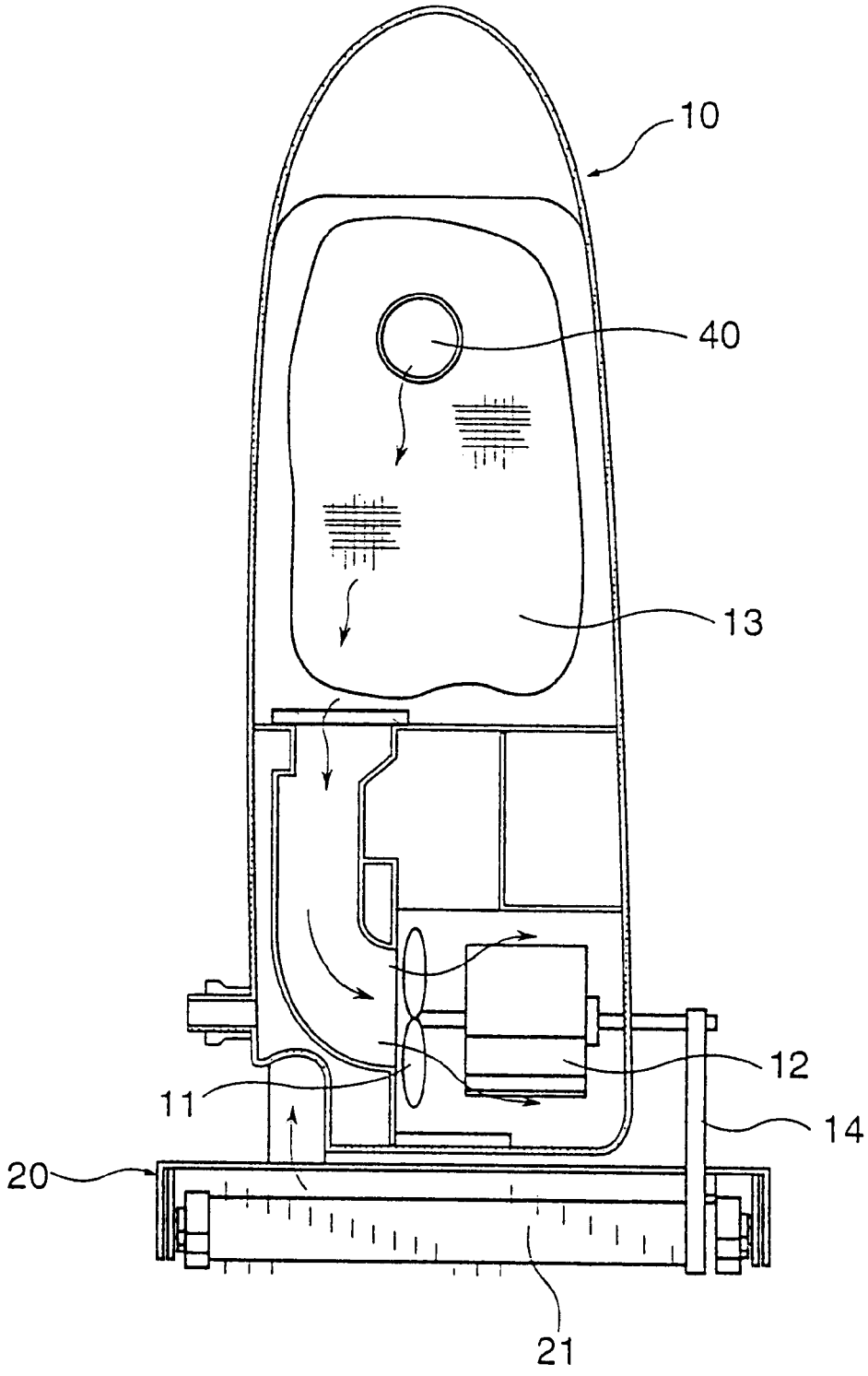
FIG 3. BACKGROUND ART
FIG. 3 is a sectional view of the conventional upright-type vacuum cleaner taken along the line II—II of FIG. 1.
Figure 4:
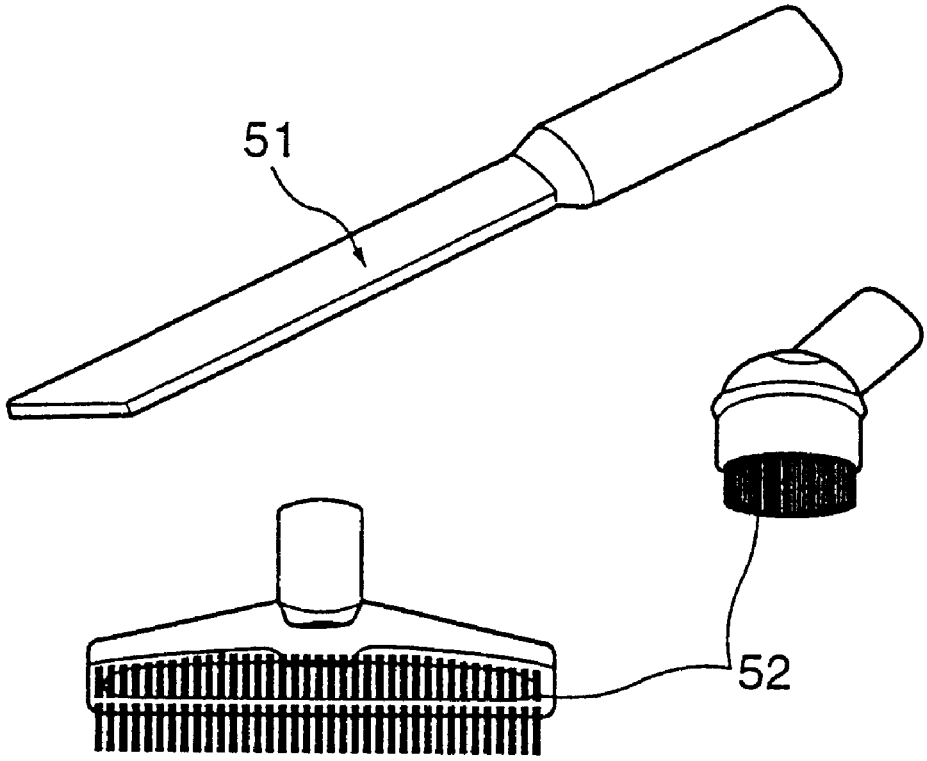
FIG 4. BACKGROUND ART
FIG. 4 is a perspective view of examples of conventional accessory tools used with the vacuum cleaner.
Figure 5:
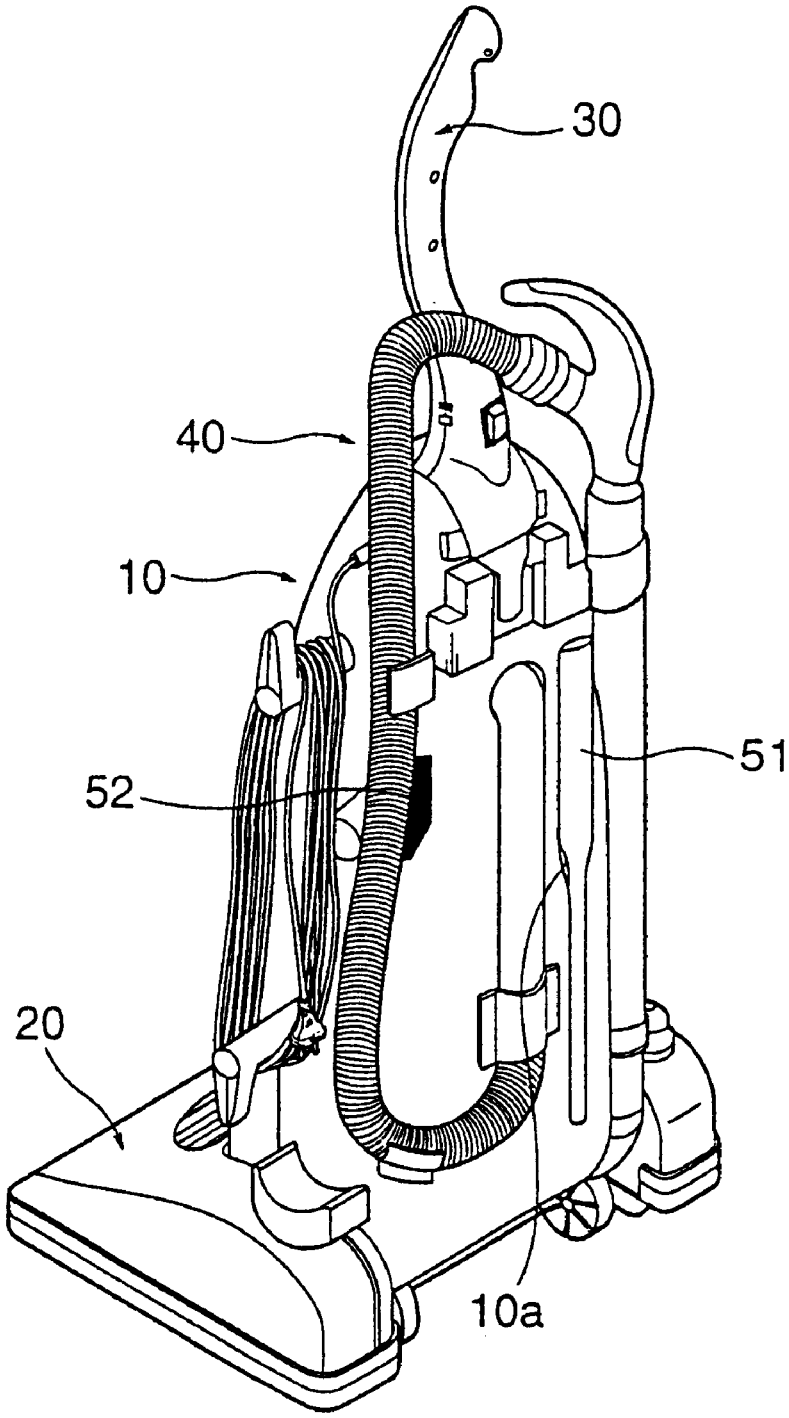
FIG 5. BACKGROUND ART
FIG. 5 is a rear perspective view of another conventional upright-type vacuum cleaner provided with a plurality of accessory tool holding recesses used for detachably holding original accessory tools on the body of the cleaner.

As shown in FIG. 3, a brush roller 21 is mounted at the front end of the suction unit 20 of the vacuum cleaner at a position around the suction nozzle of the unit 20. This brush roller 21 is connected to the fan motor 12 through a power transmission belt 14 made of rubber, thus being rotatable by the rotating force of the fan motor 12 during a cleaning process. The brush roller 21 is used for actively brushing up dust and impurities from a carpet during a cleaning process for the carpet.

The transmission belt 14 is a conventional endless belt suitable for transmitting the rotating force of the fan motor 12 to the brush roller 21.

Such a power transmission belt 14 has to be replaced with a new one at the expiry of an expected life span of the belt 14 or when the belt 14 is damaged or cut due to an unexpected external impact applied from the brush roller 21 during a cleaning process.

Therefore, it is sometimes necessary for the user to store one or more spare transmission belts. However, since the conventional vacuum cleaner is not provided with any means for storing such spare transmission belts, the spare belts cause an inconvenience to the user in the storage of them.

Such a problem experienced in the storage of the spare transmission belt 14 is overcome by the caddy unit 300 according to the third embodiment of the present invention.

As shown in FIG. 11, the caddy unit 300 according to the third embodiment of this invention has a belt holding rib 334*a*, which projects on the interior surface of the front cover 334. This rib 334*a* is used for holding a spare transmission belt 14 within the pocket 330 when necessary. The above belt holding rib 334*a* is designed to effectively and firmly hold an endless rubber belt 14.

Figure 12:
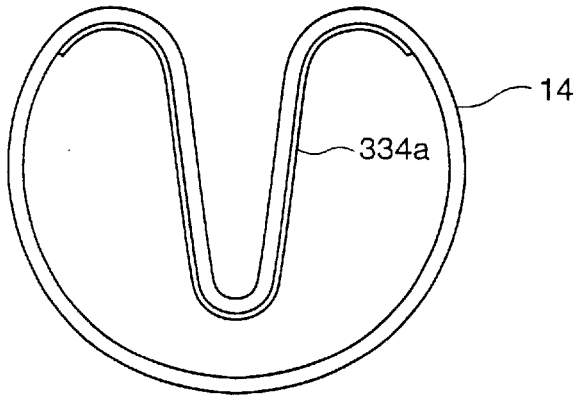
FIG. 12 is a front view, showing a spare transmission belt set on a belt holding rib formed on the front cover of the pocket provided on the tool caddy unit of the cleaner according to the present invention.

In the preferred embodiment, the belt holding rib 334*a* has a V-shaped profile. A spare rubber belt 14 held along the rib 334*a* is shown in FIG. 12.

Of course, it should be understood that the shape of the belt holding rib 334*a* may be somewhat freely changed without affecting the functioning of the invention when the rib can effectively and firmly hold a spare rubber belt 14 thereon.

Figure 13:
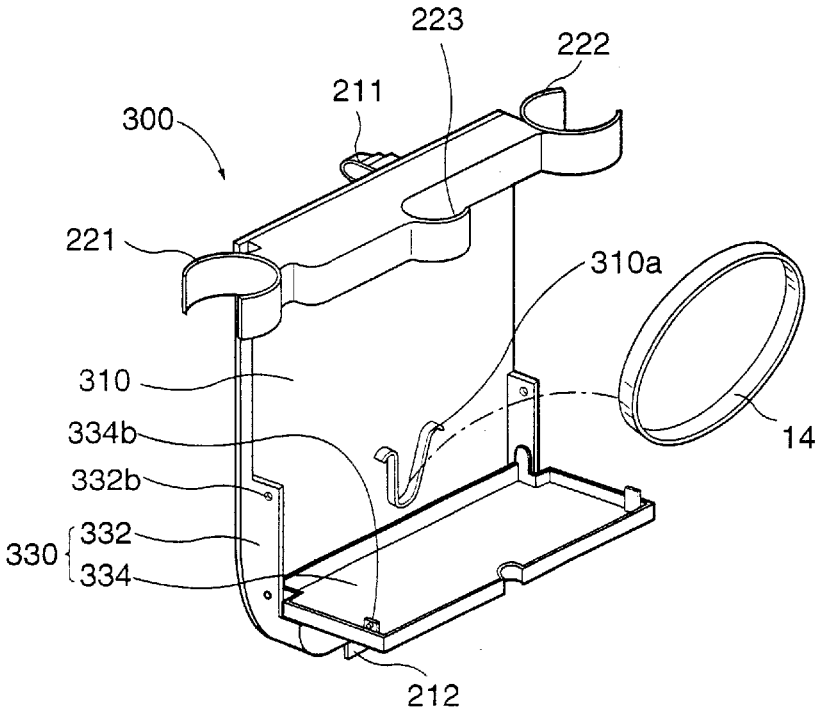
FIG. 13 is a perspective view of a detachable tool caddy unit of an upright-type vacuum cleaner in accordance with a modification of the third embodiment of the present invention.

FIG. 13 is a perspective view of a detachable tool caddy unit 300 of an upright-type vacuum cleaner in accordance with a modification of the third embodiment of the present invention. In this modification, the belt holding rib 310*a* is formed on the surface of the mounting plate 310 of the caddy unit 300 in place of the front cover 334 of the pocket 330. Therefore, the belt holding rib may be formed on the mounting plate 310 of the caddy unit 300 or on the internal surface of the front cover 334 of the pocket 330 as desired.

In this modification, the general shape of the caddy unit 300 remains the same as that described for the second embodiment, but the belt holding rib 310*a* projects on the mounting plate 310 of the caddy unit 300. Therefore, a further explanation is not deemed necessary.

As described above, the present invention provides a vacuum cleaner, which is provided with a detachable tool caddy unit for easily and detachably holding a variety of accessory tools, such as a crevice nozzle, a brush nozzle and a flexible hose, on the body of the cleaner. Due to the tool caddy unit, it is possible for a user to perform a cleaning process while holding the accessory tools on the cleaner body, and so the cleaner of this invention is very convenient to the user.

The tool caddy unit of this invention comprises a mounting plate, which is designed to be easily, simply and detachably mounted to a predetermined portion of the cleaner body, for example, the rear surface of the body. The detachable caddy unit of this invention may be preferably used with a variety of conventional vacuum cleaners.

In addition, the cleaner body has a simple design irrespective of the structure for detachably mounting the tool caddy unit to the cleaner body, and so the design flexibility of the cleaner body is improved to enhance the market competitiveness of the vacuum cleaner.

The detachable tool caddy unit of the present invention is provided with both a pocket for storing a variety of spare supplies, such as spare dust bags, and a belt holding rib for storing a spare transmission belt. Therefore, the vacuum cleaner, having such a tool caddy unit, is very convenient to the user while using the cleaner.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An upright vacuum cleaner, comprising:

a cleaner body provided with suction means for sucking dust-laden air into said cleaner body; a handle provided at an upper end of said cleaner body to allow a user to guide said upright vacuum cleaner along a floor surface;

a suction unit mounted to a lower portion of said cleaner body to engage a floor surface;

a caddy unit detachably mounted to said cleaner body and used for detachably holding a variety of accessory tools on said cleaner body, said caddy unit including a mounting plate detachably mounted to said cleaner body, with a clamp formed on said mounting plate and used for detachably holding at least one accessory tool on said mounting plate; and a mounting mechanism detachably mounting said caddy unit on a predetermined portion of said cleaner body, wherein said mounting mechanism includes:

a locking hook provided at an upper portion of said mounting plate of said caddy unit;

a locking projection provided at a lower portion of said mounting plate;

a locking hole formed on a predetermined portion of said cleaner body at a position corresponding to said locking hook and brought into detachable engagement with said locking hook when said caddy unit is mounted to said cleaner body; and a locking slot formed on a predetermined portion of said cleaner body at a position corresponding to said locking projection and brought into detachable engagement with said locking projection when said caddy unit is mounted to said cleaner body.

2. The upright vacuum cleaner according to claim 1, wherein said locking slot is downwardly inclined rearward at its front surface.

3. The upright vacuum cleaner according to claim 2, wherein a pocket is provided on a predetermined portion of said caddy unit, and is used for storing desired articles therein.

4. The upright vacuum cleaner according to claim 2, wherein a belt holding rib projects on an external surface of said mounting plate of said caddy unit, and is used for holding a spare transmission belt when necessary.

5. The upright vacuum cleaner according to claim 1, wherein said caddy unit has a width smaller than that of said cleaner body.

6. The upright vacuum cleaner according to claim 5, wherein a pocket is provided on a predetermined portion of said caddy unit, and is used for storing desired articles therein.

7. The upright vacuum cleaner according to claim 5, wherein a belt holding rib projects on an external surface of said mounting plate of said caddy unit, and is used for holding a spare transmission belt when necessary.

8. The upright vacuum cleaner according to claim 1, wherein a pocket is provided on a predetermined portion of said caddy unit, and is used for storing desired articles therein.

9. The upright vacuum cleaner according to claim 8, wherein said pocket includes:

two sidewalls perpendicularly extending out of opposite side edges of said mounting plate of said caddy unit at a lower portion of said mounting plate; and a front cover hinged to said lower portion of said mounting plate and used for selectively forming said pocket in cooperation with said two sidewalls when it is fully closed.

10. The upright vacuum cleaner according to claim 9, wherein said front cover is hinged to lower portions of said two sidewalls.

11. The upright vacuum cleaner according to claim 9, wherein a belt holding rib projects on an interior surface of said front cover, and is used for holding a spare transmission belt within said pocket when necessary.

12. The upright vacuum cleaner according to claim 1, wherein a belt holding rib projects on an external surface of said mounting plate of said caddy unit, and is used for holding a spare transmission belt when necessary.

13. A vacuum cleaner, comprising:

a cleaner body provided with suction means for sucking dust-laden air into said cleaner body;

a caddy unit detachably mounted to said cleaner body and used for detachably holding a variety of accessory tools on said cleaner body, said caddy unit including a mounting plate detachably mounted to said cleaner body, with a clamp formed on said mounting plate and used for detachably holding at least one accessory tool on said mounting plate; and a mounting mechanism detachably mounting said caddy unit on a predetermined portion of said cleaner body, wherein said mounting mechanism includes:

a locking hook provided at an upper portion of said mounting plate of said caddy unit;

a locking projection provided at a lower portion of said mounting plate;

a locking hole formed on a predetermined portion of said cleaner body at a position corresponding to said locking hook and brought into detachable engagement with said locking hook when said caddy unit is mounted to said cleaner body; and a locking slot formed on a predetermined portion of said cleaner body at a position corresponding to said locking projection and brought into detachable engagement with said locking projection when said caddy unit is mounted to said cleaner body.

14. The vacuum cleaner according to claim 13, wherein said locking slot is downwardly inclined rearward at its front surface.

15. A vacuum cleaner, comprising:

a cleaner body provided with suction means for sucking dust-laden air into said cleaner body;

a caddy unit detachably mounted to said cleaner body and used for detachably holding a variety of accessory tools on said cleaner body, said caddy unit including a mounting plate detachably mounted to said cleaner body, with a clamp formed on said mounting plate and used for detachably holding at least one accessory tool on said mounting plate; and a mounting mechanism detachably mounting said caddy unit on a predetermined portion of said cleaner body, wherein a pocket is provided on a predetermined portion of said caddy unit, and is used for storing desired articles therein.

16. The vacuum cleaner according to claim 15, wherein said pocket includes:

two sidewalls perpendicularly extending out of opposite side edges of said mounting plate of said caddy unit at a lower portion of said mounting plate; and a front cover hinged to said lower portion of said mounting plate and used for selectively forming said pocket in cooperation with said two sidewalls when it is fully closed.

17. The vacuum cleaner according to claim 16, wherein said front cover is hinged to lower portions of said two sidewalls.

18. The vacuum cleaner according to claim 16, wherein a belt holding rib projects on an interior surface of said front cover, and is used for holding a spare transmission belt within said pocket when necessary.

19. A vacuum cleaner, comprising:

a cleaner body provided with suction means for sucking dust-laden air into said cleaner body;

a caddy unit detachably mounted to said cleaner body and used for detachably holding a variety of accessory tools on said cleaner body, said caddy unit including a mounting plate detachably mounted to said cleaner body, with a clamp formed on said mounting plate and used for detachably holding at least one accessory tool on said mounting plate; and a mounting mechanism detachably mounting said caddy unit on a predetermined portion of said cleaner body, wherein a belt holding rib projects on an external surface of said mounting plate of said caddy unit, and is used for holding a spare transmission belt when necessary.

20. The upright vacuum cleaner according to claim 13, wherein said caddy unit has a width smaller than that of said cleaner body.

21. The upright vacuum cleaner according to claim 13, wherein a pocket is provided on a predetermined portion of said caddy unit, and is used for storing desired articles therein.

22. The upright vacuum cleaner according to claim 13, wherein a belt holding rib projects on an external surface of said mounting plate of said caddy unit, and is used for holding a spare transmission belt when necessary.

* * * * *